US009912081B2

(12) United States Patent
Corona

(10) Patent No.: US 9,912,081 B2
(45) Date of Patent: Mar. 6, 2018

(54) LIGHTED ELECTRICAL CONNECTOR HOUSING

(71) Applicant: DSM&T Company, Inc., Fontana, CA (US)

(72) Inventor: Sergio Corona, Upland, CA (US)

(73) Assignee: DSM&T Company, Inc., Fontana, CA (US)

( * ) Notice: Subject to any disclaimer, the term of this patent is extended or adjusted under 35 U.S.C. 154(b) by 0 days.

(21) Appl. No.: 15/374,454

(22) Filed: Dec. 9, 2016

(65) Prior Publication Data

US 2017/0170576 A1 Jun. 15, 2017

Related U.S. Application Data

(60) Provisional application No. 62/265,565, filed on Dec. 10, 2015.

(51) Int. Cl.

| | |
|---|---|
| ***H01R 4/2404*** | (2018.01) |
| ***H01R 4/24*** | (2018.01) |
| ***H01R 4/18*** | (2006.01) |
| ***H01R 13/717*** | (2006.01) |

(52) U.S. Cl.
CPC ..... *H01R 4/2404* (2013.01); *H01R 4/183* (2013.01); *H01R 13/7175* (2013.01)

(58) Field of Classification Search
CPC ... H01R 4/2404; H01R 13/7175; H01R 4/183
USPC ..... 439/393, 490, 489, 493
See application file for complete search history.

(56) References Cited

U.S. PATENT DOCUMENTS

| | | | | |
|---|---|---|---|---|
| 3,942,859 | A | 3/1976 | Korodi | |
| 4,118,690 | A | 10/1978 | Paynton | |
| 4,258,968 | A | 3/1981 | Holt | |
| 4,978,317 | A | 12/1990 | Pocrass | |
| 5,062,807 | A | 11/1991 | Guss, III | |
| 5,207,594 | A | 5/1993 | Olson | |
| 5,244,409 | A | 9/1993 | Guss, III et al. | |
| 5,409,398 | A | 4/1995 | Chadbourbe et al. | |
| 5,741,152 | A | 4/1998 | Boutros | |
| 6,159,037 | A | 12/2000 | Madsen et al. | |
| 6,165,006 | A | 12/2000 | Yeh et al. | |
| 6,257,906 | B1 | 7/2001 | Price et al. | |
| 6,319,051 | B1 | 11/2001 | Chang et al. | |
| 6,334,787 | B1 | 1/2002 | Chang | |
| 6,488,529 | B1 | 12/2002 | Chen | |
| 6,921,284 | B2 | 7/2005 | Sirichai et al. | |
| 7,121,707 | B2 | 10/2006 | Currie et al. | |
| 7,722,363 | B2 * | 5/2010 | Zhou | H01R 12/515 439/490 |
| 2001/0039140 | A1 | 11/2001 | Fasold et al. | |
| 2004/0042735 | A1 | 3/2004 | Ma | |

* cited by examiner

*Primary Examiner* — Harshad C Patel
(74) *Attorney, Agent, or Firm* — Keusey & Associates, P.C.

(57) ABSTRACT

A cover assembly for an electrical connector at the end of a sheathed cable containing several insulated wires. An insulation piercing clip couples light bulb leads to the wires. A translucent housing encloses the light bulb, said insulation piercing clip, the entire section of unsheathed insulated wires, a portion of the electrical connector and a portion of the sheathed cable. The cover assembly is illuminated by the light bulb when power flows through the electrical connector and may be color coded to indicate connector function.

17 Claims, 3 Drawing Sheets

LIGHTED ELECTRICAL CONNECTOR HOUSING

CROSS-REFERENCE TO RELATED APPLICATION

This application claims the benefit under 35 U.S.C. § 119(e) from U.S. Provisional Patent Application No. 62/265,565 entitled Lighted Electrical Connector Housing filed Dec. 10, 2015.

BACKGROUND OF THE INVENTION

1. Field of the Invention

The invention relates to a lighted electrical connector housing.

2. The Prior Art

In manufacturing appliances, connections are frequently made in an electrical panel. Power is supplied from power couplings that may be installed through the back of the electrical panel. The electrical components have supply couplings that plug into the power couplings. It can be difficult to distinguish one power coupling from another and to confirm if a proper connection has been made.

In the past several different component configurations have been proposed for lighted housings. For example, U.S. Pat. No. 5,409,398 has a resistor, diode and circuit boards coupled to plug blades for powering a light source. The components are disposed within an adapter that fits between a plug and socket. The components are exposed to the environment and the adapter takes space and represents additional cost. U.S. Pat. No. 5,207,594 and U.S. Pat. No. 7,121,707 provide various configurations for providing lighting to a household extension cord.

U.S. Pat. No. 4,258,968 provides indicators housed within a generator adaptor that plus into a residential electric meter mount. U.S. Pat. No. 4,978,317 and U.S. Pat. No. 5,741,152 and U.S. Pat. No. 6,159,037 and U.S. Pat. No. 6,319,051 and U.S. Pat. No. 6,488,529 propose an indicator installed within an RJ-type connector during the manufacturing process. U.S. Pat. No. 3,942,859 and U.S. Pat. No. 4,118,690 and U.S. Pat. No. 5,062,807 and U.S. Pat. No. 5,244,409 have lights that are sealed within an overmold housing during the manufacturing process.

U.S. Pat. No. 6,257,906 has a laser emitting a beam of light that is transmitted to an exterior portion of an ethernet jack. U.S. Pat. No. 6,165,006 and U.S. Pat. No. 6,921,284 and U.S. Published Patent Application 2004/0042735 have an LED that is installed within a USB connector during the manufacturing process. U.S. Pat. No. 6,334,787 has LEDs mounted on a circuit board. U.S. Published Patent Application 2001/0039140 provides an independent light module mounted on a module housing and having a connection to a circuit board.

The prior art proposes lighting options that are added on to the exterior of connectors thereby changing its configuration or are incorporated within connectors during the manufacturing process. The prior art does not show or suggest a lighting assembly that can be field installed on a manufactured connector without interfering with the connector's mounting on an electrical panel. Therefore, it would be desirable to provide a lighting assembly to code connectors and provide an indicator that confirms the connection integrity.

SUMMARY OF THE INVENTION

The invention includes a coupling cover that is field installable over the power coupling and the supply coupling.

The cover has two parts that snap together over a standard connector. It may include a clamshell configuration.

The cover will be color coded to allow differentiation between the equipment that the connector would be plugged in to.

For example, in a portable spa application, the blue connector goes to the pump and the red connector goes to a blower etc.

The invention further includes a light that is connected by an insulation piercing connector that when lit would indicate power through the couplings to the component.

These and other related objects are achieved by an embodiment of the invention featuring a cover assembly for an electrical connector that terminates a sheathed cable containing two or more insulated wires in which a section of the insulated wires are unsheathed for installation in the electrical connector. The assembly includes a lamp or light bulb having two leads and an insulation piercing clip to electrically couple each lead through the insulation to one wire in the unsheathed section. A housing encloses the light bulb, the insulation piercing clip, a portion of the electrical connector, the entire section of unsheathed insulated wires, and a portion of the sheathed cable. The illumination of the light bulb is visible through the housing to confirm that the insulated wires are energized.

The housing has a viewing window through which the illumination of said light bulb is visible. The viewing window is a panel of material which is thinner than the remainder of said housing. Alternatively, the housing has a translucent area through which the illumination of the light bulb is visible. In a further embodiment, the housing is made from a translucent material.

The light bulb is an LED coupled between a hot insulated wire and a neutral insulated wire. A resister is connected between the LED and one of the coupled insulated wires. The assembly includes two insulation piercing clips, wherein each insulation piercing clip is made from electrically conductive material and has a lead crimp, a piercing tip and an insulating wire crimp. The piercing tip is disposed within the insulating wire crimp so that the piercing tip contacts the wire through the insulation. Each insulation piercing clip is a multi-folded sheet metal plate having one fold forming the lead crimp, a second fold forming the piercing tip, and a third fold forming the insulated wire crimp over the piercing tip.

In one embodiment the housing includes a top cover and a bottom cover collectively forming a cable aperture at one end and a connector window at the opposite end which clamp the sheathed cable and the connector therebetween, respectively. The housing encloses a rear portion of the electrical connector and avoids interfering with the connector's mounting to a panel. Inserts may be installed within the cable aperture to reduce the size thereof. When the cable aperture is circular, the inserts are semi-circular inserts which collectively form a diameter reducing collar.

The housing includes an internal cavity and a connector window adapted to capture a connector shoulder within the internal cavity on the internal side of the connector window. The housing is an injection molded housing made from a plastic material having a color that is coded to a function of the electrical connector. The housing is molded from a translucent material. The top and bottom covers are field installable mating covers that snap fit together.

The insulation piercing clip comprises two conductive terminals connected to each other by an insulated rail, wherein each conductive terminal couples one light bulb lead to the insulation piercing clip. The lighting assembly is claimed in combination with a manufactured electrical connector that terminates a sheathed cable that is configured to mount to an electrical panel.

BRIEF DESCRIPTION OF THE DRAWING

The advantages, nature, and various additional features of the invention will appear more fully upon consideration of the illustrative embodiments now to be described in detail in connection with accompanying drawings. In the drawings wherein like reference numerals denote similar components throughout the application.

DETAILED DESCRIPTION OF THE PREFERRED EMBODIMENTS

Figure 1:
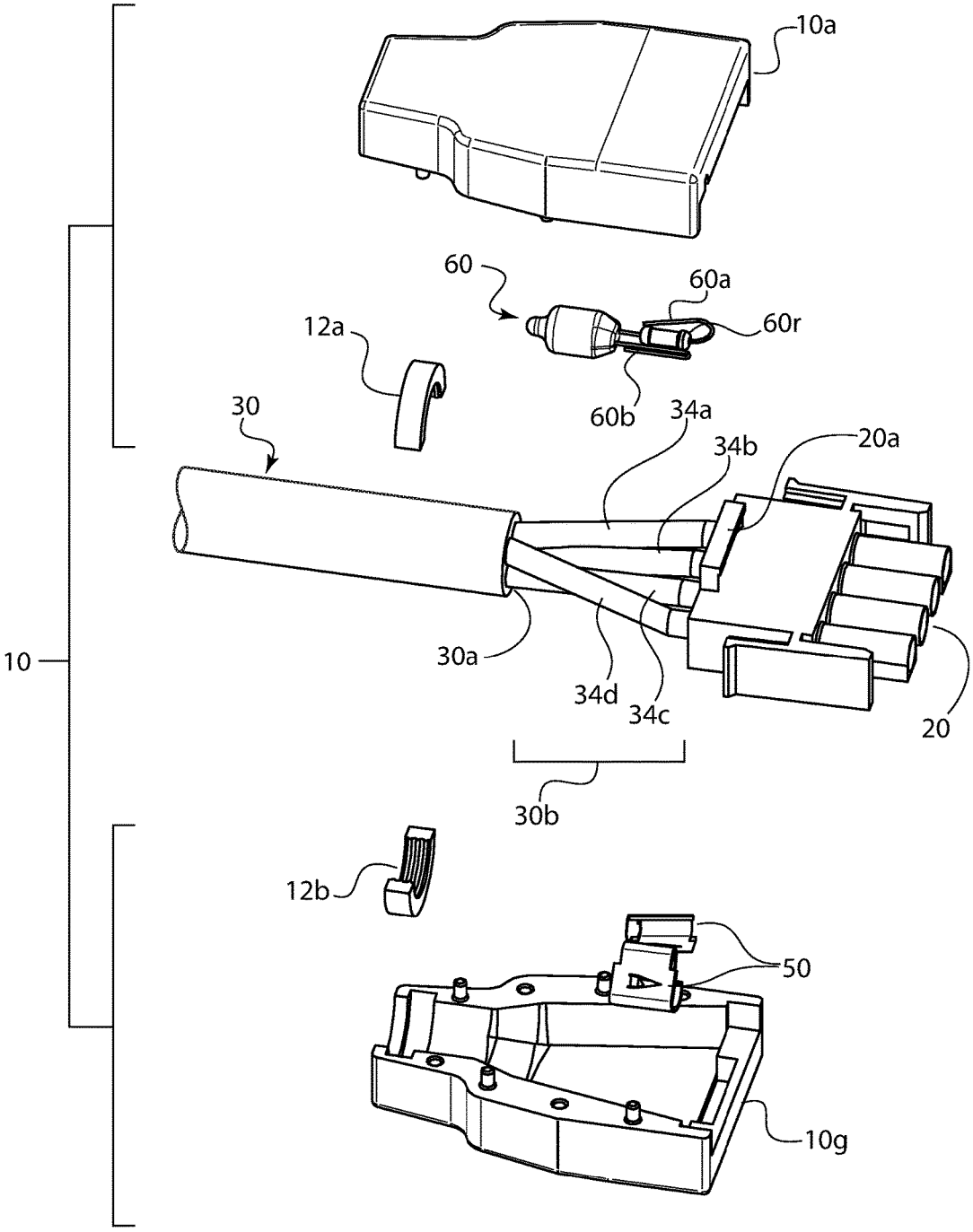
FIG. 1 is an exploded view of an embodiment of the lighting assembly with a two part cover for enclosing the light, insulation piercing clip, a section of unsheathed insulated wires, and a portion of the rear of the electrical connector.
Figure 2:
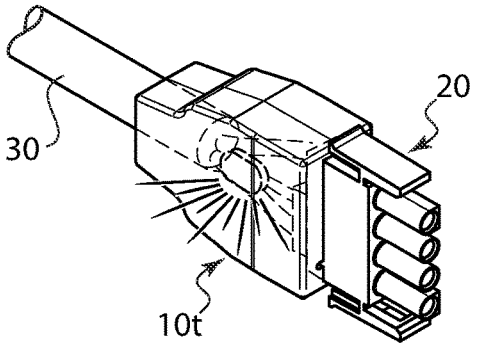
FIG. 2 is a perspective view showing the fully installed cover assembly.

FIG. 1 shows an exploded view of the cover assembly 10 in relationship to a cable 30, insulated wires 34*a,b,c,d* and electrical connector 20. In order to attach connector 20 to the terminal end of cable 30 a section of outer sheath 30*a* is removed to expose an unsheathed section 30*b* of insulated wires 34*a,b,c,d*. Insulated wires are separated from their bundled configuration within the sheath and aligned with the mounts of the electrical connector. Small portions of insulation are removed from the ends of the wires and the stripped wires are mounted to isolated contacts within the electrical connector. As shown in FIG. 2, the installed cover assembly 10 will enclose a portion of the sheathed cable 30, the entire unsheathed section 30*b* of insulated wires, and a portion of the electrical connector 20.

The electrical connector may be a male connector, a female connector, a power coupling or a supply coupling. For example, the power coupling may be installed in the electrical panel of a portable spa. A mating supply coupling extends from a blower, pump, light or other device into the electrical panel to be mated to its corresponding power coupling. Since the blower, pump and light have different power requirements, it would be desirable to color code each pair of mated couplings. By way of example, a 220*v* power coupling and mated supply coupling for a pump would both be red. A 12*v* power coupling and mated supply coupling low voltage lighting would both be green.

Cover Assembly 10 includes a translucent housing 10*t*, a light bulb 60, and an insulation piercing clip 50. Light bulb 60 has a first lead 60*a* and a second lead 60*b*. Light bulb 60 may be an LED and may also be referred to as a lamp. A resistor 60*r* may be provided in-line with one of the light bulb leads. Insulation piercing clip 50 electrically couples each light bulb lead to a different conductor within the insulated wires 34*a,b,c,d*. For example, first lead 60*a* is coupled to wire 34*a* and second lead 60*b* is coupled to wire 34*d*, so that the light bulb is illuminated when power flows through the energized circuit formed through wires 34*a* and 34*d*. In this example, wire 34*a* is a hot wire and wire 34*d* is a neutral wire. Another light bulb could be coupled to wires 34*b*/34*d* in a second energized circuit. A further light bulb could be coupled to wires 34*c*/34*d* in a third energized circuit. The three light bulbs could be of different colors to indicate which of the wires 34*a*, 34*b*, 34*c* is energized. Colored lenses disposed within the housing above each lamp could also be used.

The insulation piercing clip 50 is made of conductive metal and includes a spike that pierces the insulation of one of the insulated wires 34 to make contact with the internal conductor. The insulation piercing clip is then coupled to one of the light bulb leads. The light bulb 60 is nested between wires 34 and then enclosed within the housing 10*t*. A Diameter Reducing Collar is optionally provided to accommodate cables with diameters smaller than the housing aperture. The Cover Assembly with installed housing 10*t*, connector 20 and cable 30 is shown in FIG. 2.

The housing portion of Cover Assembly 10 is formed from a top cover 10*a* and a bottom cover 10*g* in one embodiment thereof. When fully assembled the covers provide a housing with an internal cavity to house light bulb 60, insulation piercing clip 50, a portion of the sheathed cable 30, the entire unsheathed section 30*b* of insulated wires, and a portion of the electrical connector 20.

Figure 3A:
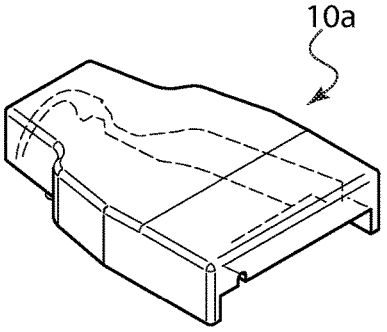
FIGS. 3A, 3B and 3C are detailed views of the top cover, bottom cover and conjoined covers forming the housing.
Figure 3B:
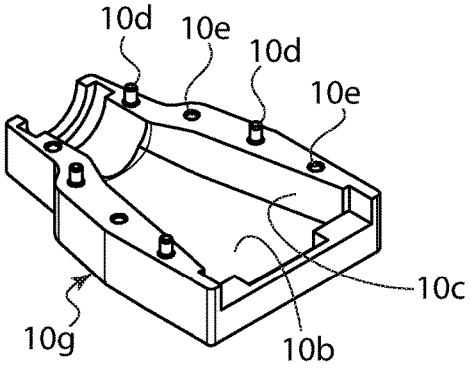
Figure 3C:
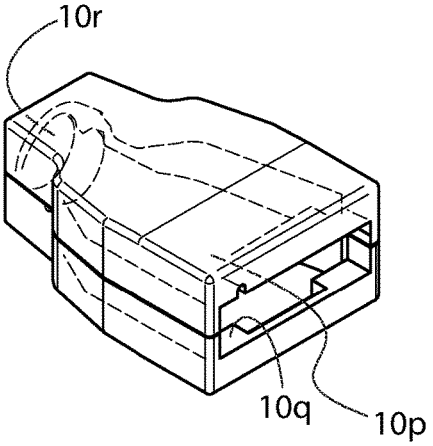

A more detailed view of the covers is shown in FIGS. 3A, 3B and 3C. Top cover 10*a* is shown in FIG. 3A and bottom cover 10*g* is shown in FIG. 3B. Exemplary of the structure of both covers is a base 10*b* and lateral walls 10*c* extending upward from base 10*b*. Lateral walls are formed on three sides of base 10*b* in the illustrated embodiment. Along the top of side lateral walls 10*c* there is a series of alternating pins 10*d* and bores 10*e*. The top cover then includes bores opposite the pins of the bottom cover. Similarly, top cover includes pins opposite the bores of the bottom cover. When the covers are brought together, the pins of each cover mate into the bores of the other cover. The pins may be retained within the bores via a friction fit. Alternatively the covers may snap together, or be glued together. The combined covers form a housing with an internal cavity 10*p*, a connector window 10*q* and a cable aperture 10*r*, as can be seen in FIG. 3C.

The internal cavity is sized to accommodate the insulated wires 34, light bulb 60 and insulation piercing clip 50. The cable aperture is sized to securely clamp the cable 30, and may be circular, or other shape depending on the cable cross-section. For circular cable apertures, semi-circular diameter reducing collars 12*a,b* are provided to securely clamp cables that are smaller than aperture 10*r*. The collars may be fashioned as inserts, in one or more sections, to reduce the size of aperture 10*r* depending on the cable cross-section. Cable aperture along with appropriately sized collars may be designed to exert pressure on the cable and provide a strain relief function. Therefore pulling forces acting on cable 30 would be resisted at cable aperture 10*r* to prevent wires 34 from being torn out of connector 20.

Connector window 10*q* is sized to securely clamp to the back end of connector 20. In the connector embodiment of FIG. 1, the back end of connector 20 includes a shoulder 20*a*. Connector Window 10*q* is configured to capture shoulder 20*a* within internal cavity 10*p*, that is, on the internal side of the window. Connector window will have a configuration matching that of the outer back end of the installed connector, without interfering with the plugging and unplugging of the connector during normal usage.

Figure 4A:
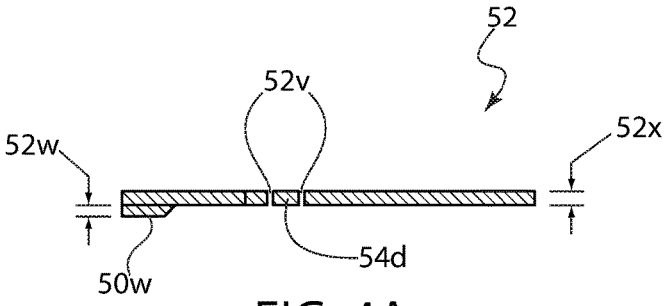
FIGS. 4A, 4B, 4C and 4D are detailed views of an embodiment of the insulation piercing clip.

An embodiment of Insulation Piecing Clip 50 may be formed by stamping a strip of metal (FIGS. 4A & 4B) and then forming three bends (FIGS. 4C & 4D) in the stamped piece. The metal strip has a thickness 52*x* on the order of 20 to 40 thousandths of an inch, for example, 0.030 inches.

Teeth 50*w* may be provided to improve the crimp connection, especially if thin gauge or thin stranded wire is being crimped. The thickness 52*w* of teeth 50*w* may be on the order of 10 to 20 thousandths of an inch, for example, 0.015 inches. It will be appreciated by those skilled in the art that the metal strip thickness and teeth thickness can be adjusted for various sized wires that are to be crimped.

Figure 4B:
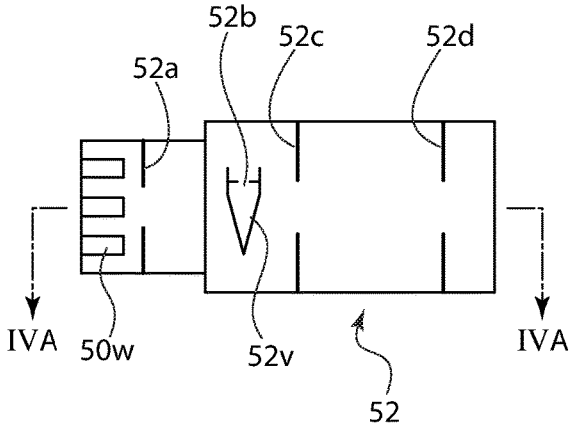
Figure 4C:
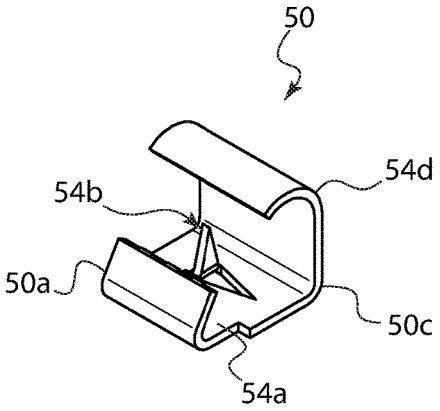
Figure 4D:
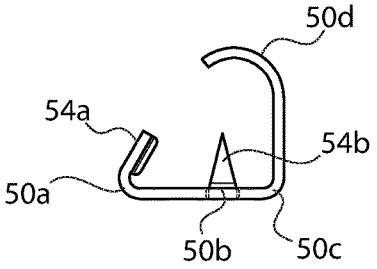

FIG. 4B shows a top plan view of metal strip 52 which has been stamped to a generally rectangular shape, with an area of reduced height on the left side thereof. The stamping operation also provides:

lead crease 52*a* which will facilitate bending of first fold 50*a* to create lead crimp 54*a;* a V-shaped tip cutout 52*v* to form piercing tip 54*b;* a tip crease 52*b* which will facilitate bending of piercing tip 54*b* perpendicular;

corner crease 52*c* which will facilitate bending of corner fold 50*c* perpendicular; and wire crease 52*d* which will facilitate bending of third fold 50*d* to create insulated wire crimp 54*d*.

The first fold 50*a* creates a lead crimp 54*a* to attach a wire lead from light bulb 60. The second fold 50*b*, corner fold 50*c* and third fold 50*d* create an insulated wire crimp 54*d*. The corner fold 50*c* creates a piercing tip 54*b*, for example by folding a triangular wedge of material at right angles to the metal strip. One of wires 34 is placed into insulated wire crimp 54*d* to force piercing tip 54*b* through the insulation in to contact with the internal conductor. Thus an electrical connection is formed though the insulation piercing clip 50 from the internal conductor of insulated wire 34 to one of the light bulb leads.

When the couplings are properly connected and power is flowing though, the light bulb becomes illuminated. The cover is made from different colors, thereby coding the connector. The cover is made from a translucent material to allow a technician to see if the light bulb is illuminated or off. The cover may be provided with a thin translucent section or lens above the lamp. The housing may be an accessory lighting assembly that is field installable on to many different commercially available connectors, power couplings or supply couplings. The insulation piercing clips can be crimped on with pliers, with the housing covers snap fitting together.

The supply coupling may be provided with a cover that is the same color as its corresponding power coupling. This color coding insures that each supply coupling is properly connected to its corresponding power coupling. The light insures that all connections are properly made and that current is flowing through the mated couplings.

The housing may be provided in various configurations. The key features of the housing are allowing the lamp illumination to be seen and clamping to a rear portion of the connector to avoid interfering with the connector's panel mounting. The insulation piercing clip may be one piece, two pieces, or a clip that is connected to the light leads or one of the covers.

Having described preferred embodiments for a lighted electrical connector housing (which are intended to be illustrative and not limiting), it is noted that modifications and variations can be made by persons skilled in the art in light of the above teachings. It is therefore to be understood that changes may be made in the particular embodiments disclosed which are within the scope and spirit of the invention as outlined by the appended claims. Having thus described aspects of the invention, with the details and particularity required by the patent laws, what is claimed and desired protected by Letters Patent is set forth in the appended claims.

What is claimed is:

1. A cover assembly for an electrical connector that terminates a sheathed cable containing two or more insulated wires in which a section of the insulated wires are unsheathed for installation in the electrical connector comprising:

a light bulb having two leads;

an insulation piercing clip to electrically couple each lead through the insulation to one wire in the unsheathed section;

a housing to enclose said light bulb, said insulation piercing clip, a portion of the electrical connector, the entire section of unsheathed insulated wires, and a portion of the sheathed cable; wherein said housing comprises a top cover and a bottom cover collectively forming a circular cable aperture at one end and a connector window at the opposite end which are adapted to clamp the sheathed cable and the connector, respectively; and a pair of semi-circular inserts which collectively form a diameter reducing collar and are installed within said circular cable aperture to reduce the size thereof, wherein the illumination of said light bulb is visible through said housing to confirm that the insulated wires are energized.

2. The cover assembly of claim 1, wherein said housing has a viewing window through which the illumination of said light bulb is visible.

3. The cover assembly of claim 2, wherein said viewing window comprises a panel of material which is thinner than the remainder of said housing.

4. The cover assembly of claim 1, wherein said housing has a translucent area through which the illumination of said light bulb is visible.

5. The cover assembly of claim 1, wherein said housing is made from a translucent material.

6. The cover assembly of claim 1, wherein said light bulb is an LED coupled between a hot insulated wire and a neutral insulated wire.

7. The cover assembly of claim 6, further comprising a resister connected between the LED and one of the coupled insulated wires.

8. The cover assembly of claim 1, further comprising two insulation piercing clips, wherein each insulation piercing clip is made from electrically conductive material and has a lead crimp, a piercing tip and an insulating wire crimp.

9. The cover assembly of claim 8, wherein said piercing tip is disposed within said insulating wire crimp so that the piercing tip contacts the wire through the insulation.

10. The cover assembly of claim 8, wherein each insulation piercing clip is a multi-folded sheet metal plate having one fold forming the lead crimp, a second fold forming the piercing tip, and a third fold forming the insulated wire crimp over said piercing tip.

11. The cover assembly of claim 1, where said housing is adapted to enclose a rear portion of the electrical connector and to avoid interfering with the connector's mounting to a panel.

12. The cover assembly of claim 1, wherein said housing includes an internal cavity and a connector window adapted to capture a connector shoulder within said internal cavity on the internal side of said connector window.

13. The cover assembly of claim 1, wherein said housing is an injection molded housing made from a plastic material having a color that is coded to a function of the electrical connector.

14. The cover assembly of claim 13, wherein said housing is molded from a translucent material.

15. The cover assembly of claim 1, wherein said top and bottom covers comprise field installable mating covers that snap fit together.

16. The cover assembly of claim 1, wherein said insulation piercing clip comprises two conductive terminals connected to each other by an insulated rail, wherein each conductive terminal couples one light bulb lead to said insulation piercing clip.

17. The cover assembly of claim 1, further comprising a manufactured electrical connector that terminates a sheathed cable that is configured to mount to an electrical panel.

* * * * *